US012029239B2

(12) United States Patent
Branton et al.

(10) Patent No.: US 12,029,239 B2
(45) Date of Patent: Jul. 9, 2024

(54) GEL COMPOSITION AND TOBACCO INDUSTRY PRODUCTS INCLUDING THE SAME

(71) Applicant: British American Tobacco (Investments) Limited, London (GB)

(72) Inventors: Peter Branton, London (GB); Arturo Salazar Avalos, London (GB); Matthew Walton, Maidenhead (GB)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 982 days.

(21) Appl. No.: 16/971,131

(22) PCT Filed: Feb. 28, 2019

(86) PCT No.: PCT/EP2019/055050
§ 371 (c)(1),
(2) Date: Aug. 19, 2020

(87) PCT Pub. No.: WO2019/166581
PCT Pub. Date: Sep. 6, 2019

(65) Prior Publication Data

US 2021/0092993 A1 Apr. 1, 2021

(30) Foreign Application Priority Data

Mar. 1, 2018 (GB) ..... 1803328

(51) Int. Cl.
*A24D 3/06* (2006.01)
*A24D 1/00* (2020.01)
(Continued)

(52) U.S. Cl.
CPC ..... *A24D 3/067* (2013.01); *A24D 1/002* (2013.01); *A24D 1/02* (2013.01); *A24D 3/048* (2013.01); *A24D 3/14* (2013.01)

(58) Field of Classification Search
None
See application file for complete search history.

(56) References Cited

U.S. PATENT DOCUMENTS 6,589,328 B1 * 7/2003 Nussinovitch ..... A23L 1/04 106/205
8,627,828 B2 1/2014 Strickland
(Continued)

FOREIGN PATENT DOCUMENTS

JP 2011245471 A 12/2011
JP 2016073226 A 5/2016
(Continued)

OTHER PUBLICATIONS

International Search Report for corresponding application PCT/EP2019/055050 filed Feb. 28, 2019; Report dated Jul. 16, 2019.
(Continued)

*Primary Examiner* — Christopher M Rodd
*Assistant Examiner* — Ronnie Kirby Jordan
(74) *Attorney, Agent, or Firm* — CANTOR COLBURN LLP

(57) ABSTRACT

A gel composition and tobacco industry products including the same The present invention relates to a gel composition comprising a gel formed from a liquid gel precursor and a gas. The present invention also relates to tobacco industry products comprising a gel composition, a method of preparing a gel composition comprising a gas, use of a gel composition comprising trapped gas, and a kit for assembling a tobacco industry product comprising a gel composition.

14 Claims, 2 Drawing Sheets

(51) Int. Cl.

| | |
|---|---|
| ***A24D 1/02*** | (2006.01) |
| ***A24D 3/04*** | (2006.01) |
| ***A24D 3/14*** | (2006.01) |

(56) References Cited

U.S. PATENT DOCUMENTS

| | | | | |
|---|---|---|---|---|
| 2003/0224090 | A1 | 12/2003 | Pearce | |
| 2017/0238607 | A1* | 8/2017 | Nordskog | A24F 47/00 |

FOREIGN PATENT DOCUMENTS

| | | | |
|---|---|---|---|
| WO | 2011069886 | A1 | 6/2011 |
| WO | 2014155252 | A2 | 10/2014 |
| WO | 2016174137 | A1 | 11/2016 |

OTHER PUBLICATIONS

Written Opinion of the International Searching Authority for corresponding application PCT/EP2019/055050 filed Feb. 28, 2019; Report dated Jul. 16, 2019.

Zuninga, et al., "Aerated food gels:, fabrication and potential applications", Trends in Food Science Publishers, vol. 19, No. 4, Apr. 1, 2008, pp. 176-187, XP022606420.

International Preliminary Report on Patentability for corresponding application PCT/EP2019/055050 filed Feb. 28, 2019; Mail Sep. 1, 2020.

* cited by examiner

GEL COMPOSITION AND TOBACCO INDUSTRY PRODUCTS INCLUDING THE SAME

FIELD OF THE INVENTION

The present invention relates to gel compositions comprising a gel and a gas and to tobacco industry products including the same.

BACKGROUND

There is a desire to provide the user of a tobacco industry product with a distinctive sensation, located at the mouth end of a tobacco industry product.

SUMMARY

According to a first aspect of the invention, there is provided a gel composition comprising a gel formed from a liquid gel precursor and a gas.

In some embodiments, the gel precursor comprises a solvent.

In some embodiments, the solvent is $H_2O$.

In some embodiments, the gel precursor comprises a gelling agent.

In some embodiments, the gelling agent comprises alginate, gelatin, agar, gum, pectin or combinations thereof.

In some embodiments, the gelling agent comprises sodium alginate.

In some embodiments the gelling agent comprises a mixture of sodium alginate and pectin mixture.

In some embodiments, the gas is added to the gel precursor before gelation.

In some embodiments, the gas comprises air, $CO_2$, $O_2$, or $N_2$.

In some embodiments, the gel further comprises an additive.

In some embodiments, the additive comprises a flavour additive.

According to a second aspect of the invention, there is provided a tipping paper for a tobacco industry product, at least partially coated with a gel composition according to the first aspect of the invention.

According to a third aspect of the invention, there is provided a filter for a tobacco industry product comprising a gel composition according to the first aspect of the invention.

According to a fourth aspect of the invention, there is provided a tobacco industry product comprising a gel composition according to the first aspect of the invention, a tipping paper according to the second aspect of the invention, and/or a filter according to the third aspect of the invention.

According to a fifth aspect of the invention, there is provided a method of preparing a gel composition comprising a gas, the method comprising forming a gel precursor by dissolving a gelling agent in a solvent, adding gas, and allowing the gel precursor to undergo gelation.

In some embodiments, the gas is added to the gel precursor under elevated pressure.

In some embodiments, the volume of gas added to the gel precursor is up to 10%, 20%, 30%, 40%, 50%, 60%, 70%, 80%, 90%, or up to 99% by volume of the gel composition.

According to a sixth aspect of the invention, there is provided use of a gel composition comprising gas to provide a fizzing sensation on the tongue and/or lips of an individual.

According to a seventh aspect of the invention, there is provided a kit for assembling a tobacco industry product, the kit comprising a gel composition according to the first aspect of the invention and a tobacco industry product.

BRIEF DESCRIPTION OF THE DRAWINGS

Embodiments of the invention will now be described, by way of example only, with reference to the accompanying drawings, in which.

DETAILED DESCRIPTION

Figure 1:
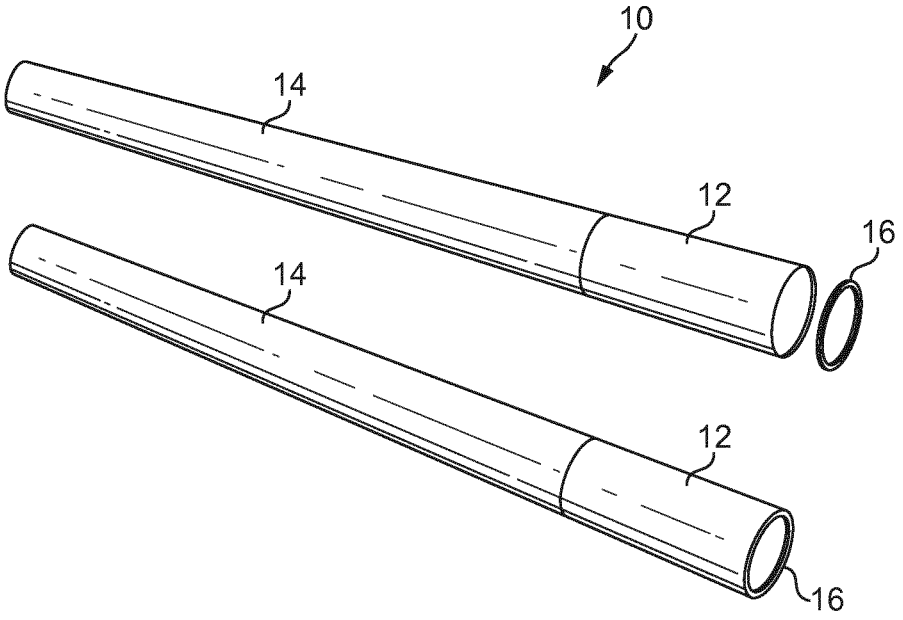
FIGS. 1, 2, 3, and 4 show various tobacco industry products including gel compositions according to respective embodiments of the present invention.

As used herein, the term "tobacco industry product" refers to any item made in, or sold by the tobacco industry, typically including a) smoking articles such as cigarettes, cigarillos, cigars, tobacco for pipes or for roll-your-own cigarettes, (whether based on tobacco, tobacco derivatives, expanded tobacco, reconstituted tobacco or tobacco substitutes); i.e. articles which typically burn tobacco during use to create smoke; b) non-smoking products incorporating tobacco, tobacco derivatives, expanded tobacco, reconstituted tobacco or tobacco substitutes such as snuff, snus, hard tobacco, and heat-not-burn (HnB) products, tobacco heating devices or tobacco heating products; and c) other nicotine-delivery systems such as inhalers, aerosol generation devices including e-cigarettes, lozenges, vapour devices, and gum; i.e. including articles which release inhalable aerosol or vapour by releasing compounds from a substrate material by heating without burning. This list is not intended to be exclusive, but merely illustrates a range of products which are made and sold in the tobacco industry.

As used herein, the term "gel composition" refers to a modified gel. In particular, a gel composition may comprise a gel and a gas, wherein the gas can be described as being trapped in the gel.

It is well known that tobacco industry products can contain additives to provide the user with different sensations. For example, additives may be included in the smokeable material to alter the flavour of mainstream smoke. Flavours or flavourants are often added to a tobacco industry product to alter the taste during use. The location of flavours or flavourants and the mechanism of their release can also vary. For example, some tobacco industry products contain a capsule located in the filter which contains a flavourant. This capsule can be crushed by the user to release the flavour when desired. Alternatively, some filters comprise a flavoured section which constantly releases flavour into the mainstream smoke.

Tobacco industry products which contain effervescent materials in the filter element have also been proposed previously. Suitable effervescent materials may, for example, generate gas and in appropriate circumstances bubbles. For example, inorganic carbonates, which will effervesce upon mixing with an acid, such as calcium or sodium carbonate, can be incorporated into a tobacco industry product filter. The reactants would need to be held separately and only mixed at the desired time to generate the gas.

Gels are widely used in the food industry, pharmaceuticals, photography, and cosmetic manufacturing. Gels typically comprise polymer molecules cross-linked to form tangled and interconnected molecular networks immersed in a liquid medium. The formation of a gel involves the association of randomly dispersed polymer segments in such a way that the three-dimensional network contains solvent in the interstices. As such, gels may be described as a solid jelly-like material which has a substantially dilute cross-linked system, which exhibits no flow in the steady-state. Gels typically behave like a solid, even though they may comprise mostly liquid, such as water. There are numerous different types of gel, such as hydrogels and organogels. Hydrogels, as the name suggests, comprise mostly water and consist of hydrophilic polymeric materials, which renders them capable of holding large amounts of water. Organogels are similar to hydrogels, but comprise a liquid organic phase instead of water.

Gels may be formed from a gel precursor. A gel precursor may be described as a component which forms a gel. Alternatively, a gel precursor may be described as a gel forming material. For example, a gelling agent may be used to prepare a gel. Gelling agents may be solid materials which dissolve in a liquid as a colloid mixture forming a weakly cohesive internal structure, i.e. a gel precursor. A colloid mixture is a mixture in which microscopically dispersed particles of one substance are suspended throughout another substance. The gel precursor may then be allowed to cure/set, forming a gel.

Typical gelling agents include polysaccharides, natural gums, starches, pectins, agar, and gelatin. Examples of polysaccharide gelling agents include alginates, such as alginic acid, sodium alginate, potassium alginate, calcium alginate, ammonium alginate, and propylene glycol alginate. Preferably, the gelling agent comprises alginate, gelatin, agar, gellan gum, or pectin. Most preferably, the gelling agent comprises an alginate, such as sodium alginate.

Alginate is a naturally occurring anionic polymer typically extracted from brown algae. Depending on the cross-linker types and cross-linking methods, alginate hydrogels can be controlled to have different barrier properties. For example, alginates can be optimised for gas absorption, i.e. a greater amount of gas can be absorbed for a given mass of alginate; gas trapping/barrier release properties, i.e. the gas can be kept in the gel for longer before diffusing out; and/or gas release properties, i.e. the gas is released when required, for example by using an external stimuli such as moisture and/or temperature.

A gelling agent may be added to a solvent, such as water, to form a solution or dispersion comprising the gelling agent, i.e. a gel precursor. The gel precursor is allowed to cure/solidify/set forming a gel. In some embodiments, it may be necessary that the solvent is heated prior to adding the gelling agent. For example, heating the solvent may enable the gelling agent to be dissolved in the solvent. Alternatively, the solution comprising the gelling agent may require heat in order to activate the gelling agent and subsequent cooling of the solution forms the gel. Alternatively, the solution may require the addition of other chemical components in order to form a gel. For example, a gel forms when a calcium salt is added to a solution of sodium alginate in water.

In some embodiments, the gel selected for use in the invention may be one that melts at a predetermined temperature. For example, gels may melt at a relatively low temperature. For example, the gel may melt when heated to a temperature of about 20° C. to about 35° C. In the food industry, such a gel is considered a "melt in mouth" type gel. Alternatively, the gel may dissolve when brought into contact with water.

In some embodiments, a gel may comprise one or more additives. For example, the gel may comprise a flavour or flavourant. As used herein, the terms "flavour" and "flavourant" refer to materials which, where local regulations permit, may be used to create a desired taste or aroma in a product for adult consumers. They may include extracts (e.g., licorice, hydrangea, Japanese white bark magnolia leaf, chamomile, fenugreek, clove, menthol, Japanese mint, aniseed, cinnamon, herb, wintergreen, cherry, berry, peach, apple, Drambuie, bourbon, scotch, whiskey, spearmint, peppermint, lavender, cardamon, celery, cascarilla, nutmeg, sandalwood, bergamot, geranium, honey essence, rose oil, vanilla, lemon oil, orange oil, cassia, caraway, cognac, jasmine, ylang-ylang, sage, fennel, piment, ginger, anise, coriander, coffee, or a mint oil from any species of the genus Mentha), flavour enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, oil, liquid, or powder. Alternatively, the gel may comprise additives which provide a desired experience to the user. For example, the gel may comprise a cooling agent, such as sorbitol or menthol. Gels may also include colours or colourants, which may be used to distinguish one gel from another.

According to the present invention, a gel composition comprises a gas. The gas may be any suitable gas, such as any one of air, nitrogen, carbon dioxide, and oxygen.

In some embodiments, the gas is distributed throughout a majority of the volume of the gel. For example, a gas is trapped in a gel. For example, the gel may be described as being impregnated with the gas. When a gel is impregnated with a gas, the gas has permeated into and throughout the gel. In some embodiments, the gel may be described as being saturated with gas. Alternatively, the gas can be said to have infused into the gel or penetrated into the gel. Alternatively, the gas can be described as being incorporated into the bulk of a gel. The gas may be described as being distributed throughout the matrix of the gel.

In preferred embodiments, the gas used is carbon dioxide. Carbon dioxide is preferred because it has a moderate critical point, is non-flammable, and has low toxicity. In some embodiments, the solution comprising the gelling agent is cooled when exposed to pressurised gas. This is because the solubility of some gases, such as carbon dioxide, increases as liquid temperature decreases. In addition, during use $CO_2$ may interact with sour receptors on the tongue for an additional sensory effect.

In some embodiments, the gel comprising a gas may be made by exposing a solution or dispersion comprising a gelling agent, i.e. a gel precursor, to the gas. In some embodiments, the gas may be in pressurised form. When the solution is exposed to the gas, the gas is distributed within or absorbed by the solution. The gel precursor is then allowed to undergo gelation to form the gel, trapping the gas within the gel. In some embodiments, the gel precursor is kept under elevated pressure when the gel is allowed to form. Alternatively, once the gel precursor has been exposed to pressurised gas, the pressure may be removed and the gel may form under atmospheric pressure. Preferably, the gel precursor is kept under elevated pressure when undergoing gelation to ensure that the gas remains absorbed in the solution. The process of exposing a gel precursor to pressurised gas causes tiny high-pressure bubbles of gas to become trapped inside the bulk of the gel. These bubbles of gas remain distributed throughout the gel when the gel precursor undergoes gelation.

Any gas which is not surrounded by the gel upon gelation will be lost. The gel acts as a barrier, preventing the trapped gas from escaping.

In some embodiments, the amount of liquid in the gel composition is greater than about 25 wt. % of liquid calculated on a wet weight basis (WWB). In some cases, the amount of liquid is greater than about 35 wt. %, 45 wt. % 55 wt. %, 65 wt. % or 75 wt. % of liquid calculated on a WWB.

In some embodiments, the volume of gas added to the gel precursor is up to 60%, up to 60%, up to 70%, up to 80%, up to 90%, or up to 99% by volume of gel composition.

In some embodiments, the gel is selected to be physically and/or chemically stable at 60% relative humidity, which is the humidity at which tobacco industry products are conventionally stored.

According to the invention, the gel is selected to release the trapped gas when the tobacco industry product is in use, that is, when the filter is held between the lips of the smoker. In some embodiments, the gel may dissolve when brought into contact with a liquid. In some embodiments, the gel may dissolve when brought into contact with saliva either on the tongue or lips of an individual. When the gel dissolves, the gas is released, resulting in a fizzing sensation felt on the lips and/or tongue of the individual. Alternatively, the sensation felt on the lips and/or tongue of the individual may be described as a tingling or sizzling sensation.

In alternative embodiments, a gel may be used that melts when heated, such as for example, when heated to a temperature from about 20° C. to about 35° C. For example, a gel may be used that melts when heated to a temperature from about 25° C. to about 30° C. A gel which melts at a temperature below about 35° C. may be capable of melting when brought into contact with the lips and/or tongue of an individual. When the gel melts, the trapped gas is released, resulting in a fizzing, tingling or sizzling sensation felt on the lips of the individual.

In one aspect of the present invention, a tobacco industry product comprises a gel composition located at the mouth end of the tobacco industry product. Locating the gel composition at the mouth end of a tobacco industry product means that the gel composition may be brought into contact with the lips and/or tongue of the user during use.

In some embodiments, the gel composition may be located on a filter element of a tobacco industry product. For example, FIG. 1 shows a tobacco industry product 10 comprising a filter element 12 and a tobacco rod 14. A gel composition 16 in the shape of an annulus is positioned at the end of the filter element 12 around the perimeter of the circular end of the filter. Thus, during use, the gel composition shall be placed in the mouth of a smoker and may be contacted by the tongue of the smoker. As shown in FIG. 1, the gel composition is positioned at the very end of the filter element 12 and does not substantially extend onto the circumferential surface of the filter element 12.

Figure 2:
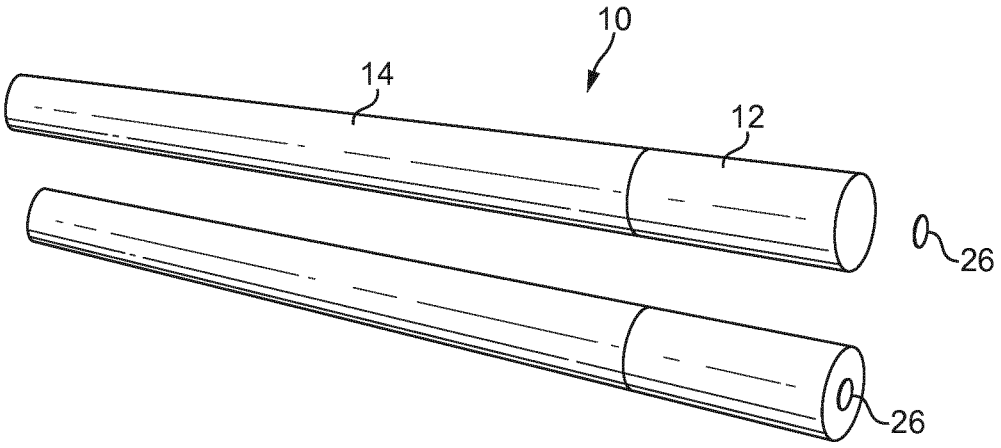

An alternative embodiment is shown in FIG. 2, where the gel composition 26 is provided as a circular portion positioned at the end of the filter element 12 of tobacco industry product 10 on the circular end of the filter element 12. The gel composition 26 is positioned centrally on the end surface of the filter element 12. During use, the gel composition 26 shall be placed in the mouth of the smoker and may be contacted by the tongue of the smoker.

Figure 3:
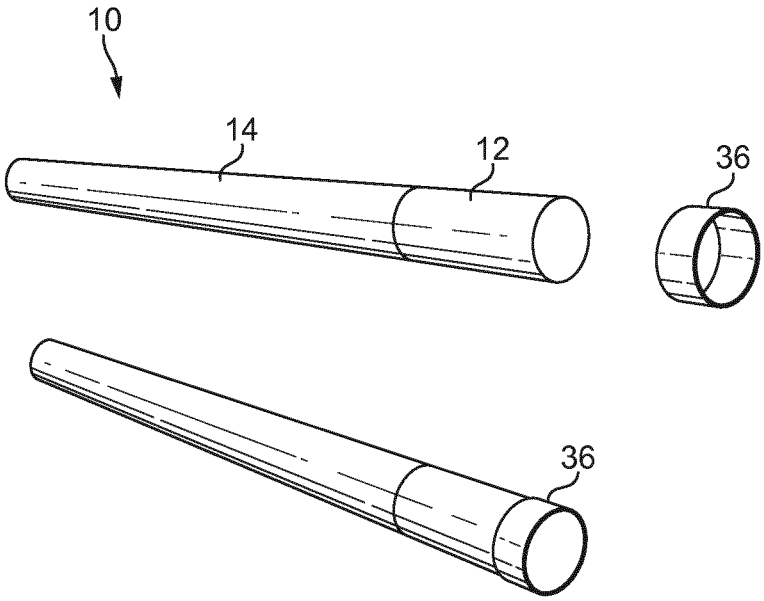

FIG. 3 shows a tobacco industry product 10 comprising a filter element 12, a tobacco rod 14, and a gel composition 36. As shown in FIG. 3, the gel composition 36 is attached to the circumferential surface and surrounds the filter element, extending partially along the length of the filter element 12 towards the tobacco rod 14. In this arrangement, the gel composition can come into contact with the smoker's lips and/or tongue during use.

Figure 4:
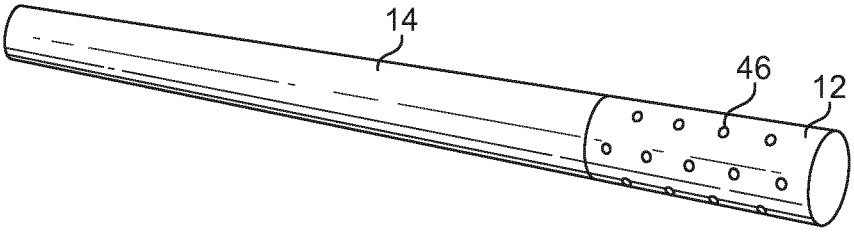

As shown in FIG. 4, the gel composition 46 is provided as individual portions arranged on the circumferential surface of the filter element 12. The portions of gel composition 46 are positioned around the entire filter element 12 and extend from the mouth end of the filter element 12 towards the tobacco rod end. In this arrangement, the gel composition 46 can come into contact with the lips and/or tongue of a smoker during use.

In some embodiments, the tipping paper of a tobacco industry product comprises a gel composition according to the invention.

In some embodiments, the gel composition is prepared prior to adhering to a tobacco industry product. For example, the gel composition may be coated onto the mouth end of the tipping paper and/or filter during manufacture. In some embodiments, the gel composition is adhered/attached/fixed to the tobacco industry product by dipping the tobacco industry product in the gel composition. In some embodiments, this may be done immediately prior to smoking.

In some embodiments, the gel composition may be located on the outside surface of a tobacco industry product filter element of any conventional construction. For example, the filter may be a "dalmatian" type filter. Alternatively, the filter may be a "cavity" type filter, and/or comprise multiple sections. The tobacco industry product filter may comprise adsorbent materials, such as activated carbon, an ion-exchange resin, a zeolite, silica or alumina.

In some embodiments, the gel composition may be provided on the plug wrap and/or tow of a tobacco industry product. A tow of a tobacco industry product comprises filtration material, for example cellulose acetate, polylactic acid and/or other suitable polymers, or may comprise a hard material such as plastic with holes.

In some embodiments, tobacco industry products according to the present invention may be provided in packaging which controls the moisture levels of the tobacco industry products, keeping them within a desired range. For example, the tobacco industry products may be kept at about 60% relative humidity. For example, the pack of tobacco industry products may be provided with a wrapper which controls the moisture level around the tobacco industry products. Alternatively, a wrapper may circumscribe each individual tobacco industry product and be used to control the moisture level around the tobacco industry product.

The gel composition may be applied to any conventional tobacco industry product. In some embodiments, a tobacco industry product is provided with the gel composition already adhered to the plug wrap and/or tow. In other embodiments, the gel composition may be provided separately to a tobacco industry product.

In some embodiments, the user may be able to modify a conventional tobacco industry product to include a gel composition to provide the user with a "fizzing" sensation during use. In some embodiments, the gel composition may be provided as individual portions or strips adhered to a backing layer which may be removed by the user and placed onto the tobacco industry product. Thin gel films may adequately adhere to a tobacco industry product without the use of an adhesive. However, in some embodiments, an adhesive may be present on a surface of the gel in order for the gel to adhere to the tobacco industry product. In an alternative embodiment, the gel composition may be present on a portion of a wrapper, which may be wrapped around the tobacco industry product, for application to the mouth end of the tobacco industry product by the user prior to use.

According to an aspect of the invention, a method of preparing a gel composition in which a gas is trapped is provided. A gel precursor is formed by combining a gelling agent with a solvent. Gas is introduced into the gel precursor. In some embodiments, this gas may be present in the solvent before it is added to the gelling agent. Alternatively or in addition, gas may be added to the gel precursor. In some embodiments, the gas is introduced into the gel precursor under elevated pressure. For example, the gas may be introduced under a pressure of 3 to 5 bar. Gelation of the gel precursor is then triggered to form the gel composition with gas trapped therein. In some embodiments, the gelation occurs under pressure.

In some embodiments the gel precursor is provided in a form that the gel composition formed therefrom will be suitable for application to a tobacco industry product. In other embodiments, the gel composition is cut to a desired form after gelation. In some embodiments, the gel precursor may be provided on tipping paper so that, upon gelation, a tipping paper comprising a gel composition comprising trapped gas, for example as a coating, is provided. In other embodiments, the gel precursor may be provided on a support sheet so that, upon gelation, a gel composition comprising trapped gas is provided on a support sheet.

In some embodiments, an adhesive is applied to a surface of the gas-impregnated gel, to allow it to be adhered to a tobacco industry product or part thereof. In some embodiments, the adhesive is a pressure-sensitive adhesive or a low-tack adhesive.

EXAMPLE 1

Sodium alginate was dissolved in carbonated water to form a solution. This solution was allowed to undergo gelation, forming a gel. The resulting gel was tested by placing it on the tongue and a weak fizzing sensation was experienced on the tongue of the tester. This example demonstrates that a gas can be absorbed by an alginate gel and released upon contact with the tongue of an individual, which causes the barrier layer of the gel to dissolve, releasing the gas trapped in the gel.

EXAMPLE 2

Sodium alginate was dissolved in carbonated water, as in Example 1. The solution was allowed to undergo gelation under elevated pressure. A moderately strong fizzing sensation was experienced when taste tested. Allowing the gel to cure/set under elevated pressure would appear to allow a greater amount gas to be incorporated into the gel when compared to Example 1. Therefore, upon release of this gas, a stronger fizzing sensation is experienced.

EXAMPLE 3

Solid gelatin was connected to a SodaStream® machine used to make carbonated drinks. The machine delivers $CO_2$ at a pressure of approximately 3-5 bar. The SodaStream® comprises a pressure release valve which prevents higher pressure from being achieved. The pressure was released and the gel was taste tested; no fizzing sensation was experienced. Exposing solid gelatin to $CO_2$ under elevated pressure does not allow the gas to penetrate into the bulk of the gelatin. There is therefore no gas which can be released to provide a fizzing sensation.

EXAMPLE 4

Gelatin was dissolved in water, pressurised with $CO_2$ from a SodaStream® machine and allowed to undergo gelation under elevated pressure. The resulting gel provided a strong fizzing sensation when taste tested. This Example demonstrates that $CO_2$ can successfully be incorporated into a solution of gelatin. The gas is then retained as the gelatin undergoes gelation and released when contacted with the tongue and/or lips of an individual.

EXAMPLE 5

Gelatin was dissolved in warm water and exposed to $CO_2$ from a SodaStream® machine and allowed to undergo gelation at atmospheric pressure. A weak fizzing sensation was experienced when taste tested. Exposing a warm solution of gelatin to $CO_2$ and not under elevated pressure, appears to allow only a limited amount of gas to be absorbed. As a result of this, a weaker fizzing sensation is provided.

EXAMPLE 6

Alginate was dissolved in carbonated water and allowed to undergo gelation under atmospheric pressure. The resulting gel provided a weak fizzing sensation when taste tested. Gas can be incorporated into modelling alginate and released upon contact with the tongue and/or lips of an individual.

EXAMPLE 7

Alginate was dissolved in water and exposed to $CO_2$ at a pressure of approximately 3-5 bar from a SodaStream®. The resulting gel provided a moderate fizzing sensation when taste tested. $CO_2$ can be trapped in modelling alginate and released upon contact with the tongue and/lips of an individual.

In order to address various issues and advance the art, the entirety of this disclosure shows by way of illustration various embodiments in which the claimed invention(s) may be practiced. The features of the disclosure are of a representative sample of embodiments only, and are not exhaustive and/or inclusive. They are presented only to assist in understanding and teach the claimed features. It is to be understood that advantages, embodiments, examples, functions, features, structures and/or other aspects of the disclosure are not to be considered limitations on the disclosure as defined by the claims or limitation on equivalents to the claims, and that other embodiments may be utilised and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. A tipping paper for a tobacco industry product, the tipping paper at least partially coated with a gel composition, the gel composition comprising:

a gel formed from a liquid gel precursor; and a gas.

2. A tipping paper according to claim 1, wherein the gel precursor comprises a solvent.

3. A tipping paper according to claim 2, wherein the solvent is $H_2O$.

4. A tipping paper according to claim 1, wherein the gel precursor comprises a gelling agent.

5. A tipping paper according to claim 4, wherein the gelling agent comprises alginate, gelatin, agar, gum, or pectin.

6. A tipping paper according to claim 5, wherein the gelling agent comprises sodium alginate.

7. A tipping paper according to claim 1, wherein the gas is added to the gel precursor before gelation.

8. A tipping paper according to claim 1, wherein the gas comprises air, $CO_2$, $O_2$, or $N_2$.

9. A tipping paper according to claim 8, wherein the gas comprises $CO_2$.

10. A tipping paper according to claim 1, wherein the gel composition further comprises an additive.

11. A tipping paper according to claim 10, wherein the additive comprises a flavour additive.

12. A filter for a tobacco industry product comprising a tipping paper according to claim 1.

13. A tobacco industry product comprising a tipping paper according to claim 1.

14. A tobacco industry product comprising a filter according to claim 12.

* * * * *